US009221637B2

(12) United States Patent
Murata et al.

(10) Patent No.: US 9,221,637 B2
(45) Date of Patent: Dec. 29, 2015

(54) SHEET CONVEYANCE MECHANISM, DOCUMENT CONVEYANCE APPARATUS AND IMAGE FORMING APPARATUS INCLUDING THE SAME

(71) Applicant: KYOCERA Document Solutions Inc., Osaka (JP)

(72) Inventors: Takuro Murata, Osaka (JP); Masayuki Kakuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/581,463

(22) Filed: Dec. 23, 2014

(65) Prior Publication Data

US 2015/0175369 A1 Jun. 25, 2015

(30) Foreign Application Priority Data

Dec. 25, 2013 (JP) ..... 2013-267339

(51) Int. Cl.

| | |
|---|---|
| ***B65H 7/02*** | (2006.01) |
| ***B65H 9/00*** | (2006.01) |
| ***B65H 7/20*** | (2006.01) |
| ***B65H 9/20*** | (2006.01) |
| ***B65H 5/06*** | (2006.01) |

(52) U.S. Cl.

CPC ..... *B65H 9/004* (2013.01); *B65H 5/06* (2013.01); *B65H 7/20* (2013.01); *B65H 9/20* (2013.01)

(58) Field of Classification Search

CPC ..... B65H 9/004; B65H 9/006; B65H 9/008
USPC ..... 271/226, 227, 228, 242, 243, 244
See application file for complete search history.

(56) References Cited

U.S. PATENT DOCUMENTS

| | | | | |
|---|---|---|---|---|
| 7,837,191 | B2 * | 11/2010 | Katou et al. | 271/228 |
| 7,900,913 | B2 * | 3/2011 | Katou et al. | 271/227 |
| 7,942,408 | B2 * | 5/2011 | Kato et al. | 271/227 |
| 2010/0148429 | A1 * | 6/2010 | Kao | 271/227 |

FOREIGN PATENT DOCUMENTS

JP 2010-173775 A 8/2010

* cited by examiner

*Primary Examiner* — Thomas Morrison
(74) *Attorney, Agent, or Firm* — Stein IP, LLC

(57) ABSTRACT

A sheet conveyance mechanism in the present disclosure has a feeding portion, a pair of registration rollers, a first sensor, a second sensor, and a conveyance control portion. The feeding portion has a drive roller. The registration rollers are disposed in a downstream side of the feeding portion. The first and second sensors detect presence of a sheet. If after a sheet is detected by the first sensor, the sheet is not detected by the second sensor by a time when a first period elapses, the conveyance control portion starts a slowdown of a rotation speed of the drive roller. If the sheet is detected by the second sensor by a time when a second period elapses after the slowdown of the rotation speed of the drive roller starts, the conveyance control portion returns the rotation speed of the drive roller to a rotation speed before the slowdown.

15 Claims, 7 Drawing Sheets

SHEET CONVEYANCE MECHANISM, DOCUMENT CONVEYANCE APPARATUS AND IMAGE FORMING APPARATUS INCLUDING THE SAME

INCORPORATION BY REFERENCE

The present application is based on and claims the benefit of priority from Japanese Patent Application No. 2013-267339 filed on Dec. 25, 2013, the contents of which are hereby incorporated by reference.

BACKGROUND

The present disclosure relates to a sheet conveyance mechanism that conveys sheets such as a paper sheet and the like, a document conveyance apparatus, and an image forming apparatus including the sheet conveyance mechanism.

In image forming apparatuses such as a facsimile, a copy machine, a printer and the like, sheet conveyance mechanisms, which include a feeding portion having a drive roller, are widely used as devices for conveying sheets such as a paper sheet, a cloth, a sheet for an OHP and the like.

Such a sheet conveyance mechanism includes: a feeding portion that has a drive roller; a detection sensor that is disposed in a downstream side of the feeding portion in a sheet conveyance direction and detects presence of a sheet; and a pair of oblique movement sensors that detect am oblique movement of a sheet. The pair of oblique movement sensors are disposed at positions away from each other by a predetermined interval in a direction intersecting the sheet conveyance direction. And, in a case where after one oblique movement sensor detects a front end portion of a sheet, the other oblique movement sensor does not detect the front end portion of the sheet by a time when a predetermined period elapses, it is determined that the sheet is oblique by a predetermined angle or more and rotation of the drive roller is stopped.

Besides, a sheet conveyance mechanism is known which is able to detect an oblique movement of a sheet by means of one detection sensor and one oblique movement sensor. In this sheet conveyance mechanism, the detection sensor is disposed in a more upstream side than the oblique movement sensor in a sheet conveyance direction, and the detection sensor and the oblique movement sensor are disposed at positions away from each other by an interval in a direction intersecting the sheet conveyance direction. And, in a case where after the detection sensor detects a front end portion of a sheet, the oblique movement sensor does not detect the front end portion of the sheet by a time when a predetermined period (period that is required for the front end portion of the sheet to be conveyed between the detection sensor and the oblique movement sensor) elapses, it is determined that the sheet is oblique by a predetermined angle or more and the rotation of the drive roller is stopped.

SUMMARY

A sheet conveyance mechanism according to an aspect of the present disclosure includes a drive source, a feeding portion, a pair of registration rollers, a first sensor, a second sensor, and a conveyance control portion. The feeding portion has a drive roller rotating by using a drive force from the drive source and conveys a sheet from an upstream side to a downstream side in a sheet conveyance direction of a sheet conveyance path. The pair of registration rollers are disposed in a downstream side of the feeding portion in the sheet conveyance direction and corrects an oblique movement of the sheet. The first sensor and the second sensor are disposed between the feeding portion and the pair of registration rollers in the sheet conveyance direction and detect presence of the sheet. The first sensor is disposed in a more upstream side than the second sensor in the sheet conveyance direction. The first sensor and the second sensor are disposed at positions away from each other by an interval in a direction intersecting the sheet conveyance direction. The conveyance control portion is able to detect an oblique movement of the sheet based on a period from a time when the first sensor detects a front end portion of the sheet to a time when the second sensor detects the front end portion of the sheet. In a case where after the front end portion of the sheet is detected by the first sensor, the front end portion of the sheet is not detected by the second sensor by a time when a predetermined first period, which is longer than a period that is required for the front end portion of the sheet to be conveyed between the first sensor and the second sensor, elapses, the conveyance control portion starts to slow down a rotation speed of the drive roller for a stop from a state in which the drive roller is rotated at a predetermined rotation speed. In a case where the front end portion of the sheet is detected by the second sensor by a time when a predetermined second period elapses after the slowdown of the rotation speed of the drive roller starts, the conveyance control portion returns the rotation speed of the drive roller to the predetermined rotation speed before the slowdown.

Still other objects of the present disclosure and specific advantages obtained by the present disclosure will become more apparent from the following embodiments described hereinafter.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Hereinafter, embodiments of the present disclosure are described with reference to the drawings.

<First Embodiment>

With reference to FIG. 1 to FIG. 9, an image forming apparatus 100, which includes a document conveyance apparatus 200 having a sheet conveyance mechanism according to a first embodiment of the present disclosure, is described. In the meantime, here, as the image forming apparatus 100, an image forming apparatus (multi-functional machine) is described as an example which is able to execute a plurality of kinds of jobs such as a print job, a scan job and the like.

<Whole Structure of Image Forming Apparatus>

Figure 1:
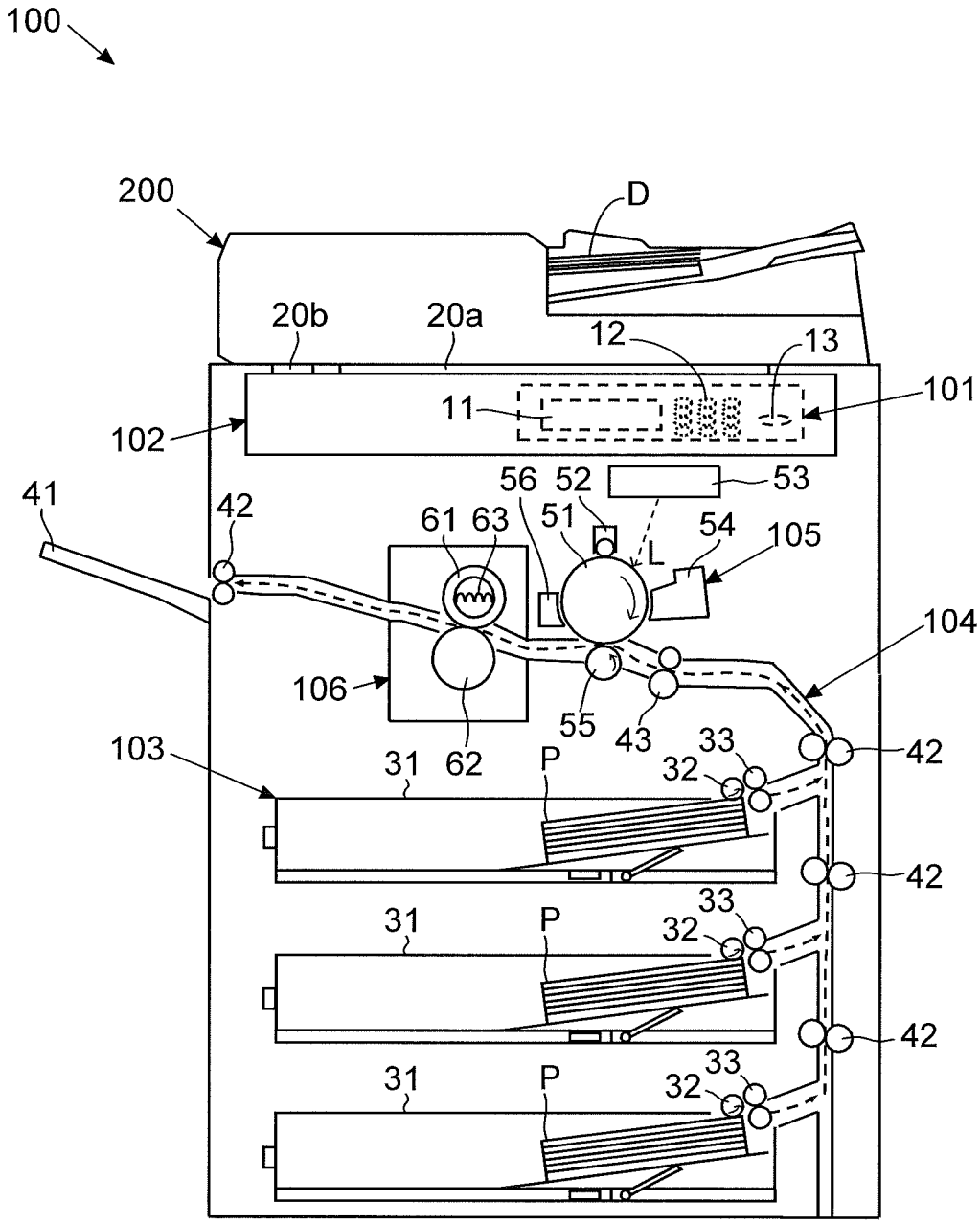
FIG. 1 is a cross-sectional view showing a whole structure of an image forming apparatus including a document conveyance apparatus that has a sheet conveyance mechanism according to a first embodiment of the present disclosure.

As shown in FIG. 1, a main body of the image forming apparatus 100 according to the present embodiment includes an operation panel 101, an image reading portion 102, a paper sheet feeding portion 103, a paper sheet conveyance portion 104, an image forming portion 105, and a fixing portion 106. And, a document conveyance apparatus 200 having the sheet conveyance mechanism according of the present disclosure is disposed on an upper portion (on the image reading portion 102) of the main body of the image forming apparatus 100 and conveys a document D as a sheet.

The operation panel 101 includes a liquid crystal display portion 11 which is disposed on an apparatus front side and whose display surface is covered by a touch panel. The liquid crystal display portion 11 displays a software key and the like for accepting an message showing an apparatus state and various inputs. Besides, the operation panel 101 is also provided with hardware keys such as a ten key pad 12, a star key 13 and the like.

The image reading portion 102 reads (scans) one side of the document D to generate image data. Although not shown, the image reading portion 102 is provided with optical members such as an exposure lamp, a mirror, a lens, an image sensor and the like. And, the image reading portion 102 shines light on to the document D that is placed on a contact glass 20*a* by a user, applies ND conversion to an output value from an image sensor that receives reflected light from the document D, and thereby generates the image data. Or, the image reading portion 102 shines light onto the document D that is conveyed onto a contact glass 20*b* by the document conveyance apparatus 200, applies ND conversion to an output value from an image sensor that receives reflected light from the document D, and thereby generates the image data. In this way, it is possible to perform printing based on the image data that is obtained by the scan of the document D performed by the image reading portion 102, and is also possible to store the image data obtained from the scan.

The paper sheet feeding portion 103 has a cassette 31 for housing paper sheets P, and supplies the paper sheets P in the cassette 31 to a paper sheet conveyance path. The paper sheet feeding portion 103 is provided with a pickup roller 32 for pulling out the paper sheets P in the cassette 31 one after another. Besides, the paper sheet feeding portion 103 is provided with a pair of paper sheet feeding rollers 33 that curb double feeding of the paper sheets P pulled out of the cassette 31 and supply the paper sheets P to the paper sheet conveyance path. The pair of paper sheet feeding rollers 33 are composed of a paper sheet feeding roller located at an upper position and a separation roller located at a lower position.

The paper sheet conveyance portion 104 conveys the paper sheet P along the paper sheet conveyance path and eventually guides it to a paper sheet delivery tray 41. The paper sheet conveyance portion 104 includes a plurality of pairs of conveyance rollers 42 that are rotatably placed in the paper sheet conveyance path. Besides, the paper sheet conveyance portion 104 includes a pair of registration rollers 43 that are disposed at a position (position immediately before the image forming portion 105) in an upstream side of the image forming portion 105 in a paper sheet conveyance direction. The pair of registration rollers 43 bend the paper sheet P, whose front end is made to collide with the pair of registration rollers 43, to correct (remedy) an oblique movement and sends the paper sheet P to the image forming portion 105 at a controlled timing.

The image forming portion 105 forms a toner image based on the image data and transfers the toner image onto the paper sheet P. The image forming portion 105 includes a photosensitive drum 51, an electrification apparatus 52, a light exposure apparatus 53, a developing apparatus 54, a transfer roller 55, and a cleaning apparatus 56.

And, during an image forming period, first, the photosensitive drum 51 is rotated and driven, and the electrification apparatus 52 electrifies a surface of the photosensitive drum 51 to a predetermined potential. Besides, the light exposure apparatus 53 outputs a light beam L based on the image data to scan the surface of the photosensitive drum 51. In this way, an electrostatic latent image is formed on the surface of the photosensitive drum 51. The developing apparatus 54 supplies toner to the electrostatic latent image formed on the surface of the photosensitive drum 51 to develop an image.

The transfer roller 55 is in tight contact with the surface of the photosensitive drum 51 to be able to rotate. And, the pair of registration rollers 43 make the paper sheet P advance between the transfer roller 55 and the photosensitive drum 51 at a controlled timing. At this time, a transfer voltage is applied to the transfer roller 55. In this way, the toner image on the surface of the photosensitive drum 51 is transferred to the paper sheet P. Thereafter, the cleaning apparatus 56 removes toner and the like remaining on the surface of the photosensitive drum 51.

The fixing portion 106 heats and pressures the toner image transferred to the paper sheet P to fix the image. The fixing portion 106 includes a heat roller 61 and a pressure roller 62. The heat roller 61 incorporates a heater 63. The pressure roller 62 comes into tight contact with the heat roller 61. And, the paper sheet P, to which the toner image is transferred, passes through between the heat roller 61 and the pressure roller 62 to be heated and pressured. In this way, the toner image is fixed onto the paper sheet P and the printing is completed. Thereafter, the printed paper sheet P is sent to the paper sheet delivery tray 41 by a pair of conveyance rollers 42.

In the meantime, besides the image reading portion 102 for reading one side of the document D, the image forming apparatus 100 is provided with a CIS unit 107 (see FIG. 2) for reading the other side opposite to the one side of the document D. The CIS unit 107 is disposed, for example, at a position along a document conveyance path 22 of the document conveyance apparatus 200 described later. In this way, it becomes possible to concurrently perform the reading of both sides of the document D.

<Structure of Document Conveyance Apparatus>

Figure 2:
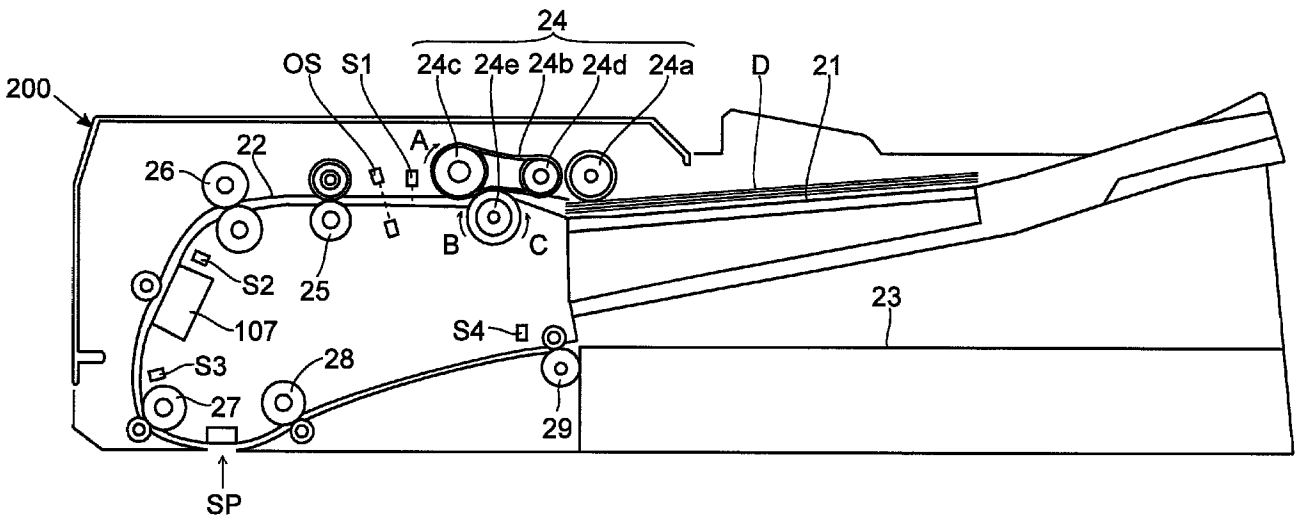
FIG. 2 is a cross-sectional view showing a structure of the document conveyance apparatus that has the sheet conveyance mechanism according to the first embodiment of the present disclosure.

As shown in FIG. 2, the document conveyance apparatus 200 supplies the document D placed on a document set tray 21 to the document conveyance path 22 (sheet conveyance path), conveys the document D along the document conveyance path 22, and eventually delivers the document D into a document delivery tray 23. And, a position of the document conveyance path 22 is a reading position SP (position opposing the contact glass 20*b*), and when the document D is conveyed to the reading position SP, one side (side disposed to face upward when being set in the document set tray 21) of the document D is read by the image reading portion 102. In the meantime, the document conveyance apparatus 200 is a high-speed machine and has a document conveyance speed (linear speed) of about 600 mm/s, for example.

The document conveyance path 22 is provided with a paper sheet feeding portion 24 (feeding portion), a pair of registration rollers 25, a pair of conveyance rollers 26, a pair of conveyance rollers 27, a pair of conveyance rollers 28, and a pair of paper sheet delivery rollers 29 in this order from an upstream side (the document set tray 21 side) to a downstream side.

The paper sheet feeding portion 24 performs an operation (paper sheet feeding operation) of pulling out the document D placed on the document set tray 21 to supply the document D to the document conveyance path 22 and sending the document D from the upstream side to the downstream side of the document conveyance path 22. The paper sheet feeding portion 24 includes a pickup roller 24*a* for pulling out the document D placed on the document set tray 21 and a paper sheet feeding belt 24*b* for supplying the document D pulled out of the document set tray 21 to send the document D from the upstream side to the downstream side of the document conveyance path 22.

The paper sheet feeding belt 24*b* is mounted on a paper sheet feeding roller 24*c* as a drive roller and a driven roller 24*d*, and turns around when the paper sheet feeding roller 24*c* rotates. The turn-around direction (rotation direction of the paper sheet feeding roller 24*c*) of the paper sheet feeding belt 24*b* is a direction (A direction) in which the document D is sent from the upstream side to the downstream side of the document conveyance path 22. In this way, when the document D pulled out of the document set tray 21 butts the paper sheet feeding belt 24*b*, the document D is supplied to the document conveyance path 22 and sent from the upstream side to the downstream side of the document conveyance path 22.

Besides, the paper sheet feeding portion 24 includes a separation roller 24*e* that is disposed at a position opposing the paper sheet feeding belt 24*b* with the document conveyance path 22 interposed. In a case where a plurality of the documents D are stacked, the separation roller 24*e* is disposed to separate the plurality of stacked documents D one after another.

Specifically, when the paper sheet feeding portion 24 is performing a paper sheet feeding operation, the separation roller 24*e* performs an operation (separation operation) of returning the document D from the downstream side to the upstream side of the document conveyance path 22. In other words, the separation roller 24*e* rotates in one direction (B direction) that is a direction in which the document D is returned from the downstream side to the upstream side of the document conveyance path 22. Because of this, in a case where a plurality of the documents D are stacked, the uppermost document D to be conveyed at a current time is sent by the paper sheet feeding portion 24 from the upstream side to the downstream side of the document conveyance path 22. On the other hand, the second and following documents D not to be conveyed at the current time are returned (or stay at the place) by the separation roller 24*e* from the downstream side to the upstream side of the document conveyance path 22. In this way, the plurality of stacked documents D are separated one after another.

Figure 5:
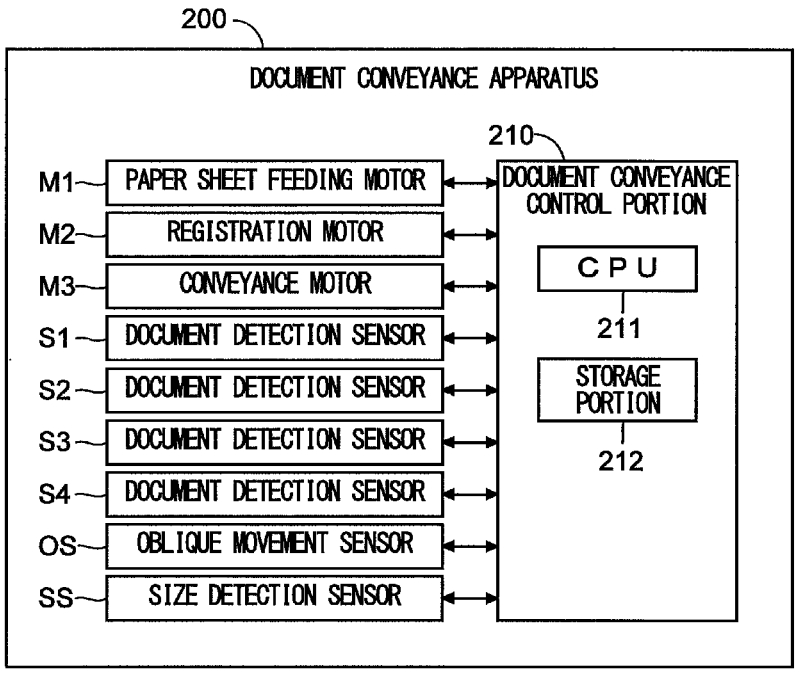
FIG. 5 is a block diagram for describing a hardware structure of the document conveyance apparatus that includes the sheet conveyance mechanism according to the first embodiment of the present disclosure.

The pickup roller 24*a*, the paper sheet feeding roller 24*c*, and the separation roller 24*e* are driven by the same paper sheet feeding motor M1 (drive source) (see FIG. 5). Besides, rotation of the paper sheet feeding motor M1 switches from a forward rotation to a backward rotation, whereby the separation roller 24*e* rotates in the other direction (C direction) as well opposite to the one direction (B direction). In other words, the separation roller 24*e* can also perform the operation (non-separation operation) of sending the document D from the upstream side to the downstream side of the document conveyance path 22.

In the meantime, a drive transmission mechanism (not shown), which transmits a drive force of the paper sheet feeding motor M1 (see FIG. 5) to the pickup roller 24*a* and the paper sheet feeding roller 24*c*, outputs a forward rotation drive of the paper sheet feeding motor M1 as a drive force for the forward rotation and also a backward rotation drive of the paper sheet feeding motor M1 as the drive force for the forward rotation. In this way, even when the paper sheet feeding motor M1 is rotating backward, the paper sheet feeding roller 24*c* continues the paper sheet feeding operation (the paper sheet feeding belt 24*b* turns around in the A direction). Such a drive transmission mechanism has a structure that includes two one-way clutches, for example.

The pair of registration rollers 25 bend the document D, whose front end is made to collide with the pair of registration rollers 25, to correct (remedy) an oblique movement of the document D. In other words, the pair of registration rollers 25 are not rotating when the front end of the document D arrives, and starts to rotate when a predetermine period elapses after the front end of the document D arrives (sends the document D from the upstream side to the downstream side of the document conveyance path 22). The pair of registration rollers 25 are driven independently by a registration motor M2 (see FIG. 5).

The pairs of conveyance rollers 26 to 28 each convey the document D from the upstream side to the downstream side of the document conveyance path 22. Besides, the pair of delivery rollers 29 deliver the document D traveling in the document conveyance path 22 to the document delivery tray 23. In the meantime, the pairs of conveyance rollers 26 to 28 and the pair of delivery rollers 29 are driven by the same conveyance motor M3 (see FIG. 5).

Besides, the document conveyance apparatus 200 is provided with document detection sensors S1, S2, S3, and S4 that are used to detect presence of the document D and control a conveyance timing of the document D. These document detection sensors S1 to S4 are each a reflecting optical sensor that has a light emitting portion for emitting light to a detection target and a light receiving portion for receiving reflected light from the detection target. And, respective outputs from the document detection sensors S1 to S4 change depending on whether the document D is located at corresponding positions or not.

The document detection sensor S1 (first sensor) is a sensor that detects presence of the document D at a position of the document conveyance path 22 (position in a more downstream side than the paper sheet feeding portion 24) between the paper sheet feeding portion 24 and the pair of registration rollers 25. The document detection sensor S2 is a sensor that detects presence of the document D at a position of the document conveyance path 22 (position near the pair of conveyance rollers 26) between the pair of conveyance rollers 26 and the pair of conveyance rollers 27. The document detection sensor S3 is a sensor that detects presence of the document D at a position of the document conveyance path 22 (position near the pair of conveyance rollers 27) between the pair of conveyance rollers 26 and the pair of conveyance rollers 27. The document detection sensor S4 is a sensor that detects presence of the document D at a position of the document conveyance path 22 (position near the pair of delivery rollers 29) between the pair of conveyance rollers 28 and the pair of delivery rollers 29.

Further, the document conveyance apparatus 200 is also provided with an oblique movement sensor OS (second sensor) that detects an oblique movement of the document D. The oblique movement sensor OS is, for example, a PI sensor that includes a light emitting portion and a light receiving portion which receives light from the light emitting portion, and detects presence of the document D. The light emitting portion and light receiving portion of the oblique movement sensor OS are disposed to oppose each other with the document conveyance path 22 interposed therebetween. In the meantime, like the oblique movement sensor OS, the document detection sensors S1, S2, S3, and S4 each may also be a PI sensor that includes a light emitting portion and a light receiving portion which receives light from the light emitting portion.

Like the detection position of the document detection sensor S1, a detection position of the oblique movement sensor OS is a position of the document conveyance path 22 (position in a more downstream side than the paper sheet feeding portion 24) between the paper sheet feeding portion 24 and the pair of registration rollers 25.

In the meantime, the paper sheet feeding portion 24, the pair of registration rollers 25, the paper sheet feeding motor M1, the document detection sensor S1, the oblique movement sensor OS and the like form the sheet conveyance mechanism.

Figure 3:
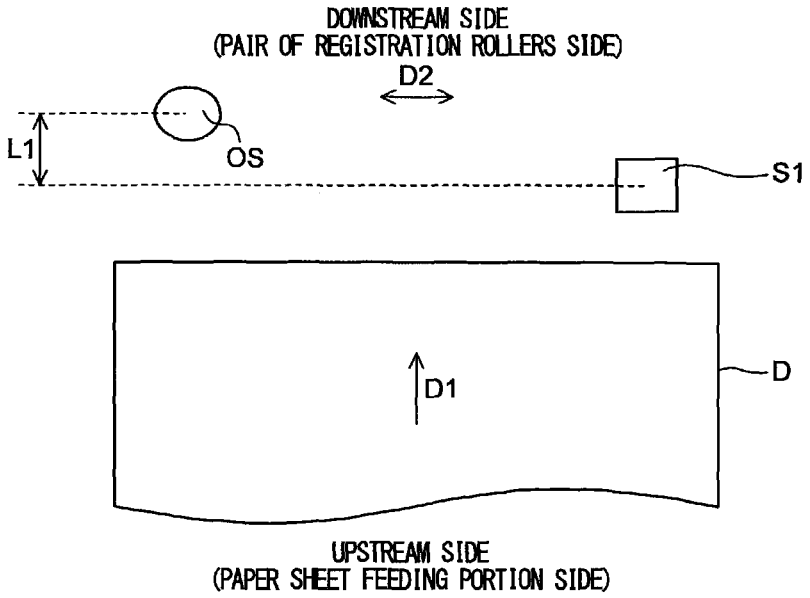
FIG. 3 is a diagrammatic view showing a document detection sensor and oblique movement sensor of the sheet conveyance mechanism according to the first embodiment of the present disclosure.

As shown in FIG. 3, the document detection sensor S1 and the oblique movement sensor OS are disposed at positions away from each other by an interval in each of a document conveyance direction D1 and a direction D2 intersecting the document conveyance direction D1. Specifically, the document detection sensor S1 is disposed at a position deviated toward one side (right side) from a center in the direction D2. Besides, the oblique movement sensor OS is disposed at a position deviated toward the other side (left side) from the center in the direction D2. Further, document detection sensor S1 is disposed at a position deviated by a distance L1 toward a more upstream side than the oblique movement sensor OS in the document conveyance direction. For example, the distance L1 between the document detection sensor S1 and the oblique movement sensor OS in the document conveyance direction D1 is about 9.5 mm. In the meantime, the reason the document detection sensor S1 and the oblique movement sensor OS are deviated from each other in the document conveyance direction D1 and the direction D2 is that an oblique movement detection is performed based on respective outputs from the document detection sensor S1 and the oblique movement sensor OS. The oblique movement detection is described later in detail.

Back to FIG. 2, the document set tray 21 is provided with a size detection sensor SS (see FIG. 5) that detects a size of the document D placed on the document set tray 21. The size detection sensor SS is, for example, an optical sensor, and changes an output in accordance with the size of the document D placed on the document set tray 21.

<Hardware Structures of Image Forming Apparatus and Document Conveyance Apparatus>

Figure 4:
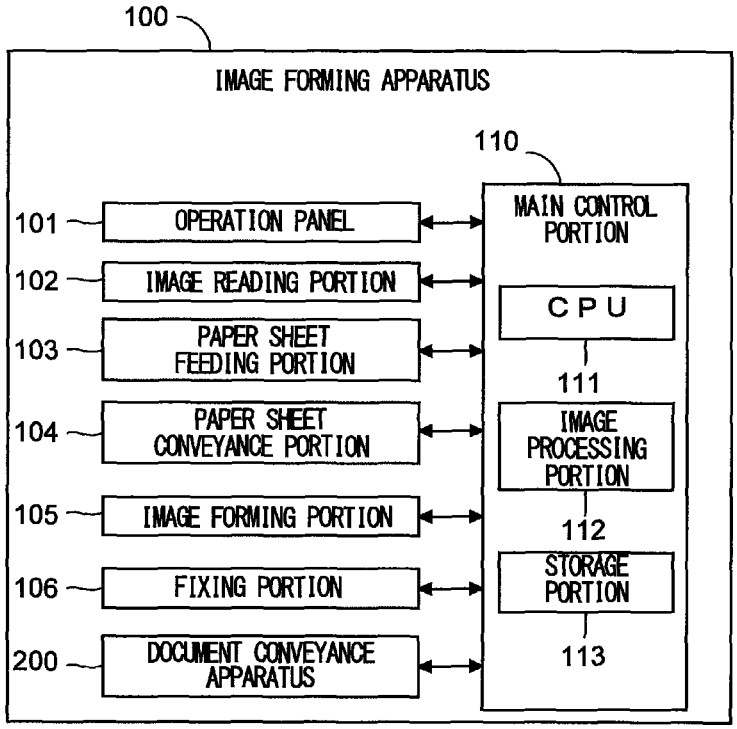
FIG. 4 is a block diagram for describing a hardware structure of the image forming apparatus that includes the sheet conveyance mechanism according to the first embodiment of the present disclosure.

As shown in FIG. 4, the image forming apparatus 100 includes a main control portion 110 that performs control of the entire apparatus. The main control portion 110 includes a CPU 111, an image processing portion 112, and a storage portion 113. The image processing portion 112 includes an ASIC dedicated to image processing, a memory and the like, and applies various image processings (enlargement/reduction, concentration change, data format conversion and the like) to image data. The storage portion 113 includes a ROM, a RAM and the like, and for example, a program and data necessary for execution of a job are stored in the ROM, and the program and data are deployed in the RAM.

The operation panel 101, the image reading portion 102, the paper sheet feeding portion 103, the paper sheet conveyance portion 104, the image forming portion 105, and the fixing portion 106 are connected to the main control portion 110 and operate based on instructions from the main control portion 110. Further, the main control portion 110 is connected to the document conveyance apparatus 200.

As shown in FIG. 5, the document conveyance apparatus 200 includes a document conveyance control portion (conveyance control portion) 210 that is connected to the main control portion 110. The document conveyance control portion 210 includes a CPU 211 and a storage portion 212. And, the document conveyance control portion 210 receives an instruction from the main control portion 110 to control the document conveyance operation of the document conveyance apparatus 200. Specifically, the document conveyance control portion 210 controls drives of the paper sheet feeding motor Ml, registration motor M2, and conveyance motor M3 to rotate various rollers and stop the rotation of them.

Besides, based on the respective outputs from the document detection sensors S1 to S4, the document conveyance control portion 210 detects a front end portion and rear end portion of the document D at the detection positions of the respective sensors (detects arrival and passage of the document D). And, the document conveyance control portion 210 determines a conveyance state (whether a jam is occurring or not) of the document D.

Further, the document conveyance control portion 210 controls timings of a rotation start and rotation stop of various rollers based on the respective outputs from the document detection sensors S1 to S4. For example, upon receiving an instruction for a conveyance start of the document D from the main control portion 110, the document conveyance control portion 210 drives the paper sheet feeding motor M1 to start the paper sheet feeding operation and the separation operation (rotates the pickup roller 24*a*, the paper sheet feeding roller 24*c*, and the separation roller 24*e*). And, the document conveyance control portion 210 detects based on the output from the document detection sensor S1 that the front end portion of the document D arrives at the detection position. Thereafter, the document conveyance control portion 210 drives the registration motor M2 to rotate the pair of registration rollers 25. In other words, the document conveyance control portion 210 gives some bend to the document D arriving at the pair of registration rollers 25 to correct an oblique movement, thereafter, sends the document D to a downstream side of the pair of registration rollers 25. At this time, a relatively small oblique movement is corrected. Thereafter, the document conveyance control portion 210 drives the conveyance motor M3 to rotate the pairs of conveyance rollers 26 to 28 and the delivery roller 29. In this way, the document D passes the reading position SP and arrives at the document delivery tray 23.

Besides, the document conveyance control portion 210 receives the output from the oblique movement sensor OS. And, the document conveyance control portion 210 detects an oblique movement of the document D based on the outputs from the oblique movement sensor OS and document detection sensor S1.

Next, an oblique detection operation of the document conveyance apparatus 200 is described.

Figure 6:
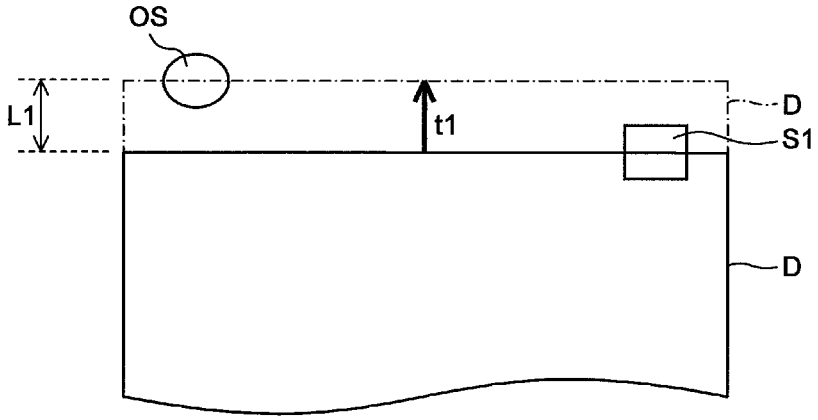
FIG. 6 is a diagrammatic view for describing an oblique movement detection operation performed in the document conveyance apparatus that has the sheet conveyance mechanism according to the first embodiment of the present disclosure.

In a case where the document D is not oblique, as shown in FIG. 6, after elapse of t1 seconds after the document detection sensor S1 detects the front end portion of the document D, the oblique movement sensor OS detects the front end portion of the document D. In the meantime, t1 is a period that is required in order for the front end portion of the document D to be conveyed through between the document detection sensor S1 and the oblique movement sensor OS, and is calculable by using the distance L1 in the document conveyance direction D1 between the document detection sensor S1 and the oblique movement sensor OS and a rotation speed (linear speed) of the paper sheet feeding roller 24*c*. For example, in a case where the document conveyance speed (linear speed) of the document conveyance apparatus 200 is about 600 mm/s and the distance L1 is about 9.5 mm, t1 becomes about 15.8 ms (=9.5 [mm]/0.6 [mm/ms]).

Figure 7:
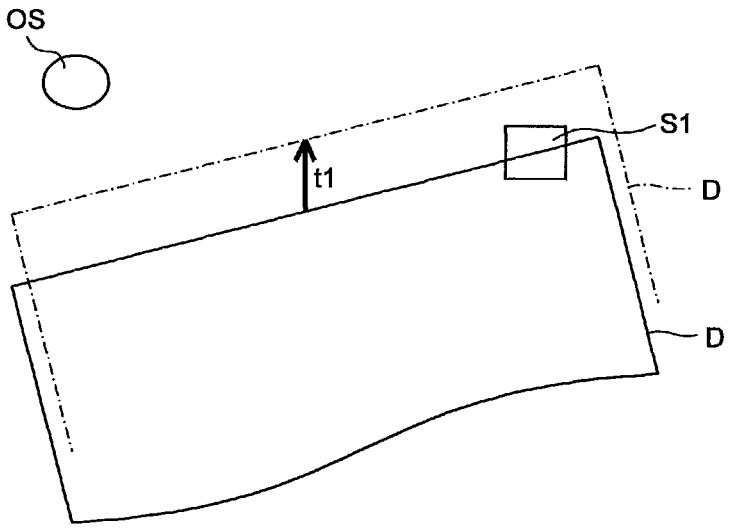
FIG. 7 is a diagrammatic view for describing an oblique movement detection operation performed in the document conveyance apparatus that has the sheet conveyance mechanism according to the first embodiment of the present disclosure.

As shown in FIG. 7, in a case where the document D is oblique toward one side (the oblique movement sensor OS side), even if t1 seconds elapse after the document detection sensor S1 detects the front end portion of the document D, the oblique movement sensor OS does not detect the front end portion of the document D. Because of this, in a case where the oblique movement sensor OS does not detect the front end portion of the document D by a time when t1+α seconds (first period) elapse after the document detection sensor S1 detects the front end portion of the document D, it is determined that the document D is oblique by a predetermined angle or more, and a stop instruction is output to the paper sheet feeding motor M1 to stop the paper sheet feeding operation. Here, the paper sheet feeding motor M1 is a stepping motor; accordingly, a rotation speed of the paper sheet feeding motor M1 is gradually slowed down and stopped after a while. In the meantime, a period for the slowdown is 30 ms, for example.

Figure 8:
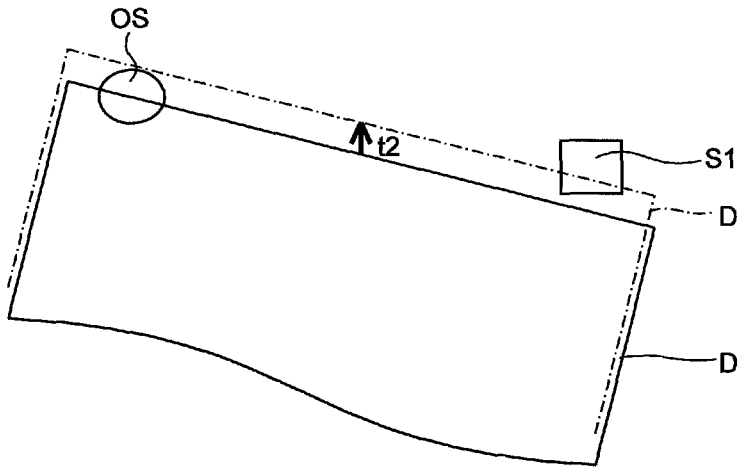
FIG. 8 is a diagrammatic view for describing an oblique movement detection operation performed in the document conveyance apparatus that has the sheet conveyance mechanism according to the first embodiment of the present disclosure.

As shown in FIG. 8, in a case where the document D is oblique toward the other side (the document detection sensor S1 side) by a predetermined angle or more, the oblique movement sensor OS detects the front end portion of the document D earlier than the document detection sensor S1. And, in a case where the document detection sensor S1 does not detect the front end portion of the document D by a time when t2 seconds (third period) shorter than t1 seconds elapse after the oblique movement sensor OS detects the front end portion of the document D in the case where the oblique movement sensor OS detects the front end portion of the document D earlier than the document detection sensor S1, it is determined that the document D is oblique by a predetermined angle or more, and a stop instruction is output to the paper sheet feeding motor M1 to stop the paper sheet feeding operation.

Here, even in a case where the document D is not oblique by the predetermine angle or more, there is a case where it is mistakenly determined that the document D is oblique by the predetermined angle or more if a sheet slip occurs during the conveyance time. Specifically, if a sheet slip occurs during the conveyance time, there is a case where the front end portion of the document D does not arrive at the oblique movement sensor OS by the time when t1+α seconds elapse after the document detection sensor S1 detects the front end portion of the document D. In this case, it is determined that the document D is oblique by the predetermined angle or more as shown in FIG. 7. And, after elapse of t1+α seconds or more after the document detection sensor S1 detects the front end portion of the document D, the oblique movement sensor OS detects the front end portion of the document D.

Because of this, in the document conveyance apparatus 200 according to the present embodiment, even in the case where t1+α seconds elapse after the document detection sensor S1 detects the document D; it is determined that the document D is oblique by the predetermined angle or more; the stop instruction is output to the paper sheet feeding motor M1 and the slowdown control is performed for the stop, in a case where the document D is conveyed to arrive at the oblique movement sensor OS before the rotation of the paper sheet feeding motor M1 completely stops (before a second period elapses and during the slowdown period) and the oblique movement sensor OS detects the front end portion of the document D, it is determined that a sheet slip is occurring. And, the stop instruction for the paper sheet feeding motor M1 is lifted, the rotation speed of the paper sheet feeding motor M1 is returned to a predetermined rotation speed before the slowdown, and the document conveyance is continued.

Also this applies to a case where the oblique movement sensor OS detects the front end portion of the document D earlier than the document detection sensor S1. Even in a case where t2 seconds elapse after the oblique movement sensor OS detects the front end portion of the document D; it is determined that the document D is oblique by the predetermined angle or more; a stop instruction is output to the paper sheet feeding motor M1 and the slowdown control is performed for the stop, in a case where the document D is conveyed to arrive at the document detection sensor S1 before the rotation of the paper sheet feeding motor M1 completely stops (before the second period elapses and during the slowdown period) and the document detection sensor S1 detects the front end portion of the document D, it is determined that a sheet slip is occurring. And, the stop instruction for the paper sheet feeding motor M1 is lifted, the rotation speed of the paper sheet feeding motor M1 is returned to a rotation speed before the slowdown, and the document conveyance is continued.

Figure 9:
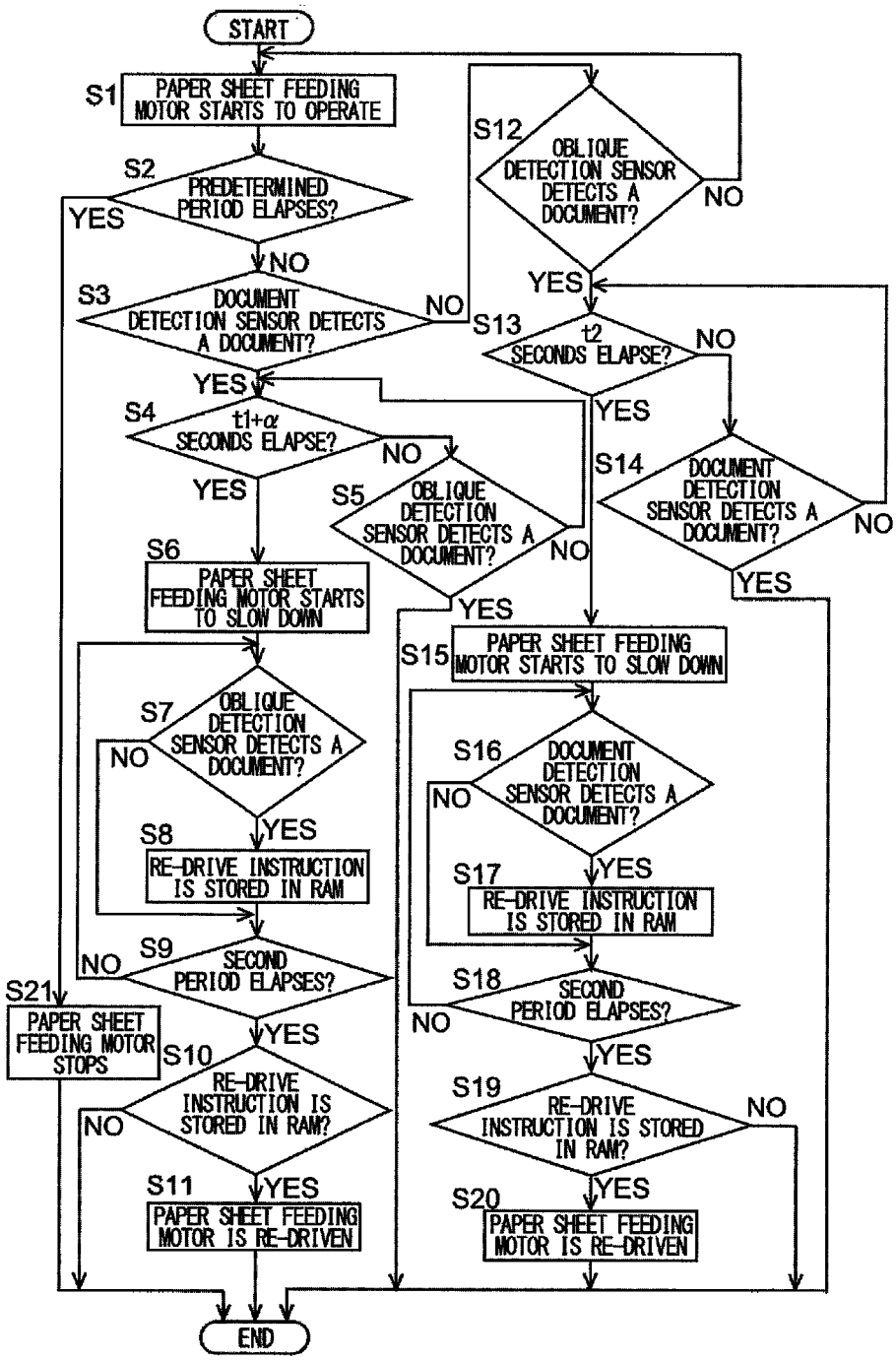
FIG. 9 is a flow chart for describing a flow of an oblique movement detection operation performed in the document conveyance apparatus that has the sheet conveyance mechanism according to the first embodiment of the present disclosure.

Hereinafter, a flow of the oblique detection operation in the document conveyance apparatus 200 is described along a flow chart shown in FIG. 9. In the meantime, the flow chart starts when the document conveyance control portion 210 receives a start instruction for the document conveyance operation from the main control portion 110.

In a step S1, the document conveyance control portion 210 starts supply of the document D from the document set tray 21 to the document conveyance path 22. In other words, the document conveyance control portion 210 starts the forward rotation drive of the paper sheet feeding motor Ml, thereby making the paper sheet feeding portion 24 perform the paper sheet feeding operation of sending the document D from the upstream side to the downstream side of the document conveyance path 22 and making the separation roller 24*e* perform the separation operation of returning the document D form the downstream side to the upstream side of the document conveyance path 22.

And, in a step S2, it is determined whether or not a predetermined period (period obtained by adding an idling period to a period required from the pickup roller 24*a* to the document detection sensor S1, which is 0.1 to 2 sec, for example) (or a predetermined number of pulses) elapses after the forward rotation drive of the paper sheet feeding motor M1 is started. In the meantime, the paper sheet feeding motor M1 is a stepping motor; accordingly, controlling the paper sheet feeding motor M1 based on the period and controlling the paper sheet feeding motor M1 based on the number of pulses are substantially the same as each other.

In the step S2, in a case where it is determined that the predetermined period (or the predetermined number of pulses) does not elapse, the control goes to a step S3, where it is determined whether or not the document detection sensor S1 detects the front end portion of the document D.

In the step S3, in a case where it is determined that the document detection sensor S1 detects the front end portion of the document D (YES), the control goes to a step S4, where it is determined whether or not t1+α seconds (or a predetermined number of pulses) elapse after the document detection sensor S1 detects the front end portion of the document D.

In the step S4, in a case where it is determined that t1+α seconds (or the predetermined number of pulses) do not elapse, the control goes to a step S5, where it is determined whether or not the oblique movement sensor OS detects the front end portion of the document D.

In the step S5, in a case where it is determined that the oblique movement sensor OS does not detect the front end portion of the document D, the control returns to the step S4. In the step S5, in a case where it is determined that the oblique movement sensor OS detects the front end portion of the document D, it is determined that the document D is not oblique by the predetermine angle or more (or oblique movement of the document D is correctable), and the document conveyance operation is continued. Thereafter, when the document D arrives at the pair of registration rollers 25, the paper sheet feeding motor M1 stops, and the document conveyance operation by the registration motor M2 and conveyance motor M3 is continued.

In the step S4, in a case where it is determined that t1+α seconds (or the predetermined number of pulses) elapse, the control goes to a step S6. And, it is determined that the document D is oblique by the predetermined angle or more, the slowdown of the paper sheet feeding motor M1 and paper sheet feeding roller 24*c* is started, and the control goes to a step S7, where it is determined whether or not the oblique movement sensor OS detects the front end portion of the document D.

In the step S7, in a case where it is determined that the oblique movement sensor OS does not detect the front end portion of the document D, the control goes to a step S9. In the step S7, in a case where it is determined that the oblique movement sensor OS detects the front end portion of the document D, the control goes to a step S8. And, a re-drive instruction for re-driving the paper sheet feeding motor M1 is stored into the RAM, and the control goes to the step S9.

In the step S9, it is determined whether or not the second period elapses. In a case where the second period does not elapse (the rotation of the paper sheet feeding motor M1 does not stop), the control returns to the step S7. In a case where it is determined that the second period elapses, the control goes to a step S10, where it is determined whether or not a re-drive instruction for re-driving the paper sheet feeding motor M1 is stored in the RAM.

In the step S10, in a case where it is determined that a re-drive instruction is not stored in the RAM, it is determined that the oblique movement of the document D is not correctable, an error message is displayed on the liquid crystal display portion 11, and the stop of the document conveyance operation is kept. In the step S10, in a case where it is determined that a re-drive instruction is stored in the RAM, it is determined that a sheet slip is occurring (or the oblique movement of the document D is correctable), and the control goes to a step S11, where the paper sheet feeding motor M1 is re-driven, and the document conveyance operation is resumed. Thereafter, when the document D arrives at the pair of registration rollers 25, the paper sheet feeding motor M1 stops, and the document conveyance operation by the registration motor M2 and conveyance motor M3 is continued.

In the step S3, in a case where it is determined that the document detection sensor S1 does not detect the front end portion of the document D, the control goes to a step S12, where it is determined whether or not the oblique movement sensor OS detects the front end portion of the document D.

In the step S12, in a case where it is determined that the oblique movement sensor OS does not detect the front end portion of the document D, the control returns to the step S2. In the step S12, in a case where it is determined that the oblique movement sensor OS detects the front end portion of the document D, the control goes to a step S13, where it is determined whether or not t2 seconds (or a predetermined number of pulses) elapse after the oblique movement sensor OS detects the front end portion of the document D.

In the step S13, in a case where it is determined that t2 seconds (or the predetermined number of pulses) do not elapse, the control goes to a step S14, where it is determined whether or not the document detection sensor S1 detects the front end portion of the document D.

In the step S14, in a case where it is determined that the document detection sensor S1 does not detect the front end portion of the document D, the control returns to the step S13. In the step S14, in a case where it is determined that the document detection sensor S1 detects the front end portion of the document D, it is determined that the oblique movement of document D is correctable, and the document conveyance operation is continued. Thereafter, when the document D arrives at the pair of registration rollers 25, the paper sheet feeding motor M1 stops, and the document conveyance operation by the registration motor M2 and conveyance motor M3 is continued.

In the step S13, in a case where it is determined that t2 seconds (or the predetermined number of pulses) elapse, the control goes to a step S15. And, it is determined that the document D is oblique by the predetermined angle or more, the slowdown of the paper sheet feeding motor M1 and paper sheet feeding roller 24*c* is started, and the control goes to a step S16, where it is determined whether or not the document detection sensor S1 detects the front end portion of the document D.

In the step S16, in a case where it is determined that the document detection sensor S1 does not detect the front end portion of the document D, the control goes to a step S18.

In the step S16, in a case where it is determined that the document detection sensor S1 detects the front end portion of the document D, the control goes to a step S17. And, a re-drive instruction for re-driving the paper sheet feeding motor M1 is stored into the RAM, and the control goes to the step S18.

In the step S18, it is determined whether or not the second period elapses. In a case where it is determined that the second period does not elapse (the rotation of the paper sheet feeding motor M1 does not stop), the control returns to the step S16. In a case where it is determined that the second period elapses, the control goes to a step S19, where it is determined whether or not a re-drive instruction for re-driving the paper sheet feeding motor M1 is stored in the RAM.

In the step S19, in a case where it is determined that a re-drive instruction is not stored in the RAM, it is determined that the oblique movement of the document D is not correctable, an error message is displayed on the liquid crystal display portion 11, and the stop of the document conveyance operation is kept. In the step S19, in a case where it is determined that a re-drive instruction is stored in the RAM, it is determined that the oblique movement and sheet slip of the document D are occurring but the oblique movement is correctable, and the control goes to a step S20, where the paper sheet feeding motor M1 is re-driven, and the document conveyance operation is resumed. Thereafter, when the document D arrives at the pair of registration rollers 25, the paper sheet feeding motor M1 stops, and the document conveyance operation by the registration motor M2 and conveyance motor M3 is continued.

Besides, in the step S2, in a case where it is determined that the predetermined period (e.g., 0.1 to 2 sec) (or the predetermined number of pulses) elapses, the control goes to a step S21. And, it is determined that defective paper sheet feeding (faulty feeding) is occurring at the paper sheet feeding portion 24, the paper sheet feeding motor M1 and the paper sheet feeding roller 24*c* are slowed down, and the document conveyance operation is stopped. In this case, an error message is displayed on the liquid crystal display portion 11 and the document conveyance apparatus 200 stops.

In the present embodiment, as described above, the document detection sensor S1 is disposed in the more upstream side than the oblique movement sensor OS in the document conveyance direction, and the document detection sensor S1 and the oblique movement sensor OS are disposed at the positions away from each other by the interval in the direction D2 intersecting the sheet conveyance direction D1. In this way, in the case where after the document detection sensor S1 detects the front end portion of the document D, the oblique detection sensor OS does not detect the front end portion of the document D by the time when t1+α seconds elapse, it is possible to determine that the document D is oblique by the predetermined angle or more. Because of this, to detect the oblique movement of the document D, it is unnecessary to dispose a pair of sensors away from each other by a predetermined interval in the direction D2 intersecting the document conveyance direction Dl; accordingly, it is possible to simplify the structure of the sheet conveyance mechanism.

Besides, in a case where the front end portion of the document D is detected by the oblique movement sensor OS by a time when the second period elapses after the slowdown of the rotation speed of the paper sheet feeding roller 24*c* is started, the rotation speed of the paper sheet feeding roller 24*c* is returned to the predetermined rotation speed before the slowdown. In this way, in the case where a sheet slip occurs, it is possible to alleviate the document D being mistakenly determined to be oblique by the predetermined angle or more. Because of this, it is possible to alleviate the document conveyance operation of the sheet conveyance mechanism being stopped when the document D is not oblique by the predetermined or more; accordingly, it is possible to improve convenience for the user.

Besides, as described above, the second period is the period that is required from the start of the slowdown of the rotation speed of the paper sheet feeding roller 24*c* to the stop of the rotation of the paper sheet feeding roller 24*c*. In this way, in the case where the front end portion of the document D is detected by the oblique movement sensor OS by the time when the rotation of the paper sheet feeding roller 24*c* stops after the slowdown of the rotation speed of the paper sheet feeding roller 24*c* is started, the rotation speed of the paper sheet feeding roller 24*c* is returned to the predetermined rotation speed before the slowdown; accordingly, it is possible to further improve the convenience for the user.

Besides, as described above, in the case where the front end portion of the document D is not detected by the document detection sensor S1 by the time when t2 seconds shorter than t1+α seconds elapse after the front end portion of the document D is detected by the oblique movement sensor OS with the front end portion of the document D not detected by the document detection sensor S1, the rotation speed of the paper sheet feeding roller 24*c* is slowed down, and in the case where the front end portion of the document D is detected by the document detection sensor S1 before the rotation of the paper sheet feeding roller 24*c* stops, the rotation speed of the paper sheet feeding roller 24*c* is returned to the predetermined rotation speed before the slowdown. In this way, even in the case where the document D is oblique toward the other side (the document detection sensor S1 side), it is possible to alleviate the document conveyance operation of the sheet conveyance mechanism being stopped in the case where the oblique movement of the document D is correctable; accordingly, it is possible to further improve the convenience for the user.

Besides, as described above, in the case where the front end portion of the document D is detected by the oblique movement sensor OS before the rotation of the paper sheet feeding roller 24*c* stops after the slowdown of the rotation speed of the paper sheet feeding roller 24*c* is started, the rotation of the paper sheet feeding roller 24*c* is temporarily stopped, thereafter, resumed. In other words, the rotation of the paper sheet feeding motor M1 is temporarily stopped, thereafter, resumed. In this way, it is possible to alleviate the paper sheet feeding motor M1 and its peripheral components and the like having trouble and malfunctioning.

<Second Embodiment>

Figure 10:
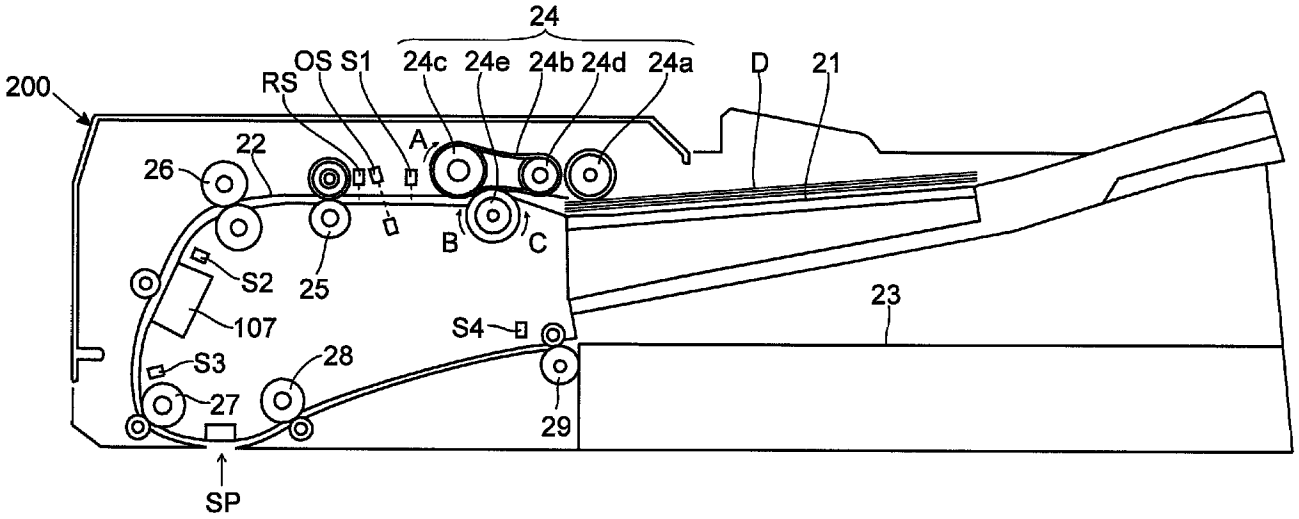
FIG. 10 is a cross-sectional view showing a structure of a document conveyance apparatus that has a sheet conveyance mechanism according to a second embodiment of the present disclosure.

In a second embodiment, as shown in FIG. 10, a registration sensor RS for detecting presence of the document D is disposed. The registration sensor RS may be a reflecting optical sensor or a PI sensor.

Upon detecting the front end portion of the document D, the registration sensor RS outputs a document detection signal to the document conveyance control portion 210. After detecting the document detection signal, the document conveyance control portion 210 holds the stop state of the pair of registration rollers 25 until a predetermined holding period elapses. In this way, the document D is made to collide with the pair of registration rollers 25, and the document D made to collide with the pair of registration rollers 25 bends. And, the document conveyance control portion 210 drives the pair of registration rollers 25 after the predetermined holding period elapses. In this way, the document D has its oblique movement corrected, thereafter, is conveyed. In the meantime, the registration sensor RS may be disposed in the first embodiment as well.

Here, in the second embodiment, in a case where the rotation speed of the paper sheet feeding motor M1 is returned to the predetermined rotation speed before the slowdown after the slowdown of the rotation speed of the paper sheet feeding motor M1 is started, the holding period, which extends from the time when the registration sensor RS detects the front end portion of the document D to the time when the rotation of the pair of registration rollers 25 is started, is extended by a predetermined period from an initial value.

The other structures and control method of the second embodiment are the same as the above first embodiment.

In the present embodiment, as described above, in the case where the rotation speed of the paper sheet feeding roller 24*c* is returned to the predetermined rotation speed before the slowdown after the slowdown of the rotation speed of the paper sheet feeding roller 24*c* is started, the holding period, which extends from the time when the registration sensor RS detects the front end portion of the document D to the time when the rotation of the pair of registration rollers 25 is started, is extended by the predetermined period from the initial value. In this way, even in a case where the oblique movement of the document D is relatively large, it is possible to surely correct the oblique movement of the document D.

The other effects of the second embodiment are the same as the above first embodiment.

It should be considered that the embodiments disclosed this time are examples in all respects and are not limiting. The scope of the present disclosure is not indicated by the above description of the embodiments but by the claims, further all modifications within the scope of the claims and the meaning equivalent to the claims are covered.

For example, the example is described, in which the sheet conveyance mechanism in the present disclosure is used in the paper sheet feeding portion of the document conveyance apparatus, but the present disclosure is not limited to this. The sheet conveyance mechanism may be used in the paper sheet feeding portion (paper sheet cassette), the paper sheet feeding portion of the stack tray, and a portion other than the paper sheet feeding portion. Besides, the sheet conveyance mechanism may be used in an apparatus other than the image forming apparatus.

Besides, in the above embodiments, the example is described, in which the rotation of the paper sheet feeding motor M1 is temporarily stopped, thereafter, resumed, but the present disclosure is not limited to this. Before the rotation of the paper sheet feeding motor M1 stops, it is possible to return the rotation speed of the paper sheet feeding motor M1 to the predetermined rotation speed before the slowdown.

Besides, in the above embodiments, the example is described, in which even in the case where the oblique movement sensor OS (second sensor) detects the front end portion of the document D earlier than the document detection sensor S1 (first sensor), there is a case where the oblique movement of the document D is correctable, but the present disclosure is not limited to this. If the distance L1 between the document detection sensor S1 and the oblique movement sensor OS becomes large, it becomes impossible to correct the oblique movement of the document D in the case where the oblique movement sensor OS detects the front end portion of the document D earlier than the document detection sensor S1. In this case, in the case where after the front end portion of the document D is detected by the document movement sensor S1 (first sensor), the front end portion of the document D is detected by the oblique movement sensor OS (second sensor) by a time when a period (fourth period) shorter than t1 seconds elapses, the rotation speed of the paper sheet feeding roller 24*c* may be slowed down. By employing such a structure, in the case where the document D is oblique toward the document detection sensor S1 (first sensor) side by the predetermined angle or more, it is possible to easily stop the document conveyance operation of the sheet conveyance mechanism.

Besides, in the above second embodiment, the example is described, in which the registration sensor RS is disposed, but the oblique movement sensor OS may double as the registration sensor.

Besides, in the above embodiments, the example is described, in which the paper sheet feeding portion 24 is provided with the paper sheet feeding belt 24*b* and the separation roller 24*e* that returns the document D to the upstream side in the document conveyance direction, but the present disclosure is not limited to this. The paper sheet feeding portion may be composed of the paper sheet feeding roller and a retard roller that is tightly pressured by the paper sheet feeding roller to be driven to rotate and incorporates a torque limiter.

What is claimed is:

1. A sheet conveyance mechanism comprising:

a drive source, a feeding portion that has a drive roller rotating by using a drive force from the drive source and conveys a sheet from an upstream side to a downstream side in a sheet conveyance direction of a sheet conveyance path, a pair of registration rollers that are disposed in a downstream side of the feeding portion in the sheet conveyance direction and corrects an oblique movement of the sheet, a first sensor and a second sensor that are disposed between the feeding portion and the pair of registration rollers in the sheet conveyance direction and detect presence of the sheet, and a conveyance control portion, wherein the first sensor is disposed in a more upstream side than the second sensor in the sheet conveyance direction, the first sensor and the second sensor are disposed at positions away from each other by an interval in a direction intersecting the sheet conveyance direction, the conveyance control portion is able to detect an oblique movement of the sheet based on a period from a time when the first sensor detects a front end portion of the sheet to a time when the second sensor detects the front end portion of the sheet, in a case where after the front end portion of the sheet is detected by the first sensor, the front end portion of the sheet is not detected by the second sensor by a time when a predetermined first period, which is longer than a period that is required for the front end portion of the sheet to be conveyed between the first sensor and the second sensor, elapses, the conveyance control portion starts to slow down a rotation speed of the drive roller for a stop from a state in which the drive roller is rotated at a predetermined rotation speed, in a case where the front end portion of the sheet is detected by the second sensor by a time when a predetermined second period elapses after the slowdown of the rotation speed of the drive roller starts, the conveyance control portion returns the rotation speed of the drive roller to the predetermined rotation speed before the slowdown, and the second period is a period that is required from the start of the slowdown of the rotation speed of the drive roller to a stop of rotation of the drive roller.

2. The sheet conveyance mechanism according to claim 1, wherein the drive source is a stepping motor, and the second period is a period that is required from a start of a slowdown of the stepping motor to a stop of the stepping motor.

3. The sheet conveyance mechanism according to claim 1, wherein in a case where the front end portion of the sheet is not detected by the first sensor by a time when a predetermined third period shorter than the first period elapses after the front end portion of the sheet is detected by the second sensor with the front end portion of the sheet not detected by the first sensor, the conveyance control portion slows down the rotation speed of the drive roller, and in a case where the front end portion of the sheet is detected by the first sensor by a time when the second period elapses after the slowdown of the rotation speed of the drive roller starts, the conveyance control portion returns the rotation speed of the drive roller to the predetermined rotation speed before the slowdown.

4. The sheet conveyance mechanism according to claim 1, wherein in a case where after the front end portion of the sheet is detected by the first sensor, the front end portion of the sheet is detected by the second sensor by a time when a predetermined fourth period, which is shorter than the period that is required for the front end portion of the sheet to be conveyed between the first sensor and the second sensor, elapses, the conveyance control portion slows down the rotation speed of the drive roller.

5. The sheet conveyance mechanism according to claim 1, wherein in a case where the front end portion of the sheet is detected by the second sensor by the time when the second period elapses after the slowdown of the rotation speed of the drive roller is started, the rotation of the drive roller is temporarily stopped, thereafter, resumed.

6. The sheet conveyance mechanism according to claim 1, wherein further, a registration sensor for detecting presence of the sheet being disposed in a downstream side of the second sensor in the sheet conveyance direction, and in a case where the rotation speed of the drive roller is returned to the predetermined rotation speed before the slowdown after the slowdown of the rotation speed of the drive roller is started, the conveyance control portion extends a holding period, which extends from a time when the registration sensor detects the front end portion of the sheet to a time when rotation of the pair of registration rollers is started, from an initial value.

7. A document conveyance apparatus comprising the sheet conveyance mechanism according to claim 1.

8. An image forming apparatus comprising the sheet conveyance mechanism according to claim 1.

9. A sheet conveyance mechanism comprising:

a drive source, a feeding portion that has a drive roller rotating by using a drive force from the drive source and conveys a sheet from an upstream side to a downstream side in a sheet conveyance direction of a sheet conveyance path, a pair of registration rollers that are disposed in a downstream side of the feeding portion in the sheet conveyance direction and corrects an oblique movement of the sheet, a first sensor and a second sensor that are disposed between the feeding portion and the pair of registration rollers in the sheet conveyance direction and detect presence of the sheet, and a conveyance control portion, wherein the first sensor is disposed in a more upstream side than the second sensor in the sheet conveyance direction, the first sensor and the second sensor are disposed at positions away from each other by an interval in a direction intersecting the sheet conveyance direction, the conveyance control portion is able to detect an oblique movement of the sheet based on a period from a time when the first sensor detects a front end portion of the sheet to a time when the second sensor detects the front end portion of the sheet, in a case where after the front end portion of the sheet is detected by the first sensor, the front end portion of the sheet is not detected by the second sensor by a time when a predetermined first period, which is longer than a period that is required for the front end portion of the sheet to be conveyed between the first sensor and the second sensor, elapses, the conveyance control portion starts to slow down a predetermined rotation speed, at which the drive roller is rotating, for a stop, in a case where the front end portion of the sheet is detected by the second sensor by a time when a predetermined second period elapses after the slowdown of the rotation speed of the drive roller starts, the conveyance control portion returns the rotation speed of the drive roller to the predetermined rotation speed before the slowdown, and in a case where the front end portion of the sheet is detected by the second sensor by the time when the second period elapses after the slowdown of the rotation speed of the drive roller is started, the rotation of the drive roller is temporarily stopped, thereafter, is resumed.

10. The sheet conveyance mechanism according to claim 9, wherein the drive engine is a stepping motor, and the second period is a period that is required from a start of a slowdown of the stepping motor to a stop of the stepping motor.

11. The sheet conveyance mechanism according to claim 9, wherein in a case where the front end portion of the sheet is not detected by the first sensor by a time when a predetermined third period shorter than the first period elapses after the front end portion of the sheet is detected by the second sensor with the front end portion of the sheet not detected by the first sensor, the conveyance control portion slows down the rotation speed of the drive roller, and in a case where the front end portion of the sheet is detected by the first sensor by a time when the second period elapses after the slowdown of the rotation speed of the drive roller starts, the conveyance control portion returns the rotation speed of the drive roller to the rotation speed before the slowdown.

12. The sheet conveyance mechanism according to claim 9, wherein in a case where after the front end portion of the sheet is detected by the first sensor, the front end portion of the sheet is detected by the second sensor by a time when a predetermined fourth period, which is shorter than the period that is required for the front end portion of the sheet to be conveyed between the first sensor and the second sensor, elapses, the conveyance control portion slows down the rotation speed of the drive roller.

13. The sheet conveyance mechanism according to claim 9, wherein further, a registration sensor for detecting presence of the sheet being disposed in a downstream side of the second sensor in the sheet conveyance direction, and in a case where the rotation speed of the drive roller is returned to the predetermined rotation speed before the slowdown after the slowdown of the rotation speed of the drive roller is started, the conveyance control portion extends a holding period, which extends from a time when the registration sensor detects the front end portion of the sheet to a time when rotation of the pair of registration rollers is started, from an initial value.

14. A document conveyance apparatus comprising the sheet conveyance mechanism according to claim 9.

15. An image forming apparatus comprising the sheet conveyance mechanism according to claim 9.

* * * * *